US007603971B2

(12) United States Patent
Allen

(10) Patent No.: US 7,603,971 B2
(45) Date of Patent: Oct. 20, 2009

(54) VALVE OPERATING MECHANISM

(75) Inventor: Jeffrey Allen, Attleborough (GB)

(73) Assignee: Scion-Sprays Limited, Hethel Engineering Centre, Hethel, Norwich, Norfolk (GB)

( * ) Notice: Subject to any disclaimer, the term of this patent is extended or adjusted under 35 U.S.C. 154(b) by 428 days.

(21) Appl. No.: 11/550,082

(22) Filed: Oct. 17, 2006

(65) Prior Publication Data

US 2007/0095310 A1 May 3, 2007

(30) Foreign Application Priority Data

Oct. 28, 2005 (GB) ..... 0522069.4

(51) Int. Cl.
*F01L 1/34* (2006.01)

(52) U.S. Cl. ..... 123/90.16; 123/90.39; 123/90.61; 74/569

(58) Field of Classification Search ..... 123/90.16, 123/90.39, 90.44, 90.48, 90.6, 90.2, 90.27, 123/90.31, 90.61; 74/559, 567, 569
See application file for complete search history.

(56) References Cited

U.S. PATENT DOCUMENTS 5,555,860 A 9/1996 Wride
6,688,267 B1 2/2004 Raghavan

FOREIGN PATENT DOCUMENTS

| | | |
|---|---|---|
| DE | 10119686 A1 | 11/2002 |
| WO | 9421897 | 9/1994 |
| WO | 03062609 A1 | 7/2003 |
| WO | 2005052326 A1 | 6/2005 |

OTHER PUBLICATIONS

International Search Report from GB0522069.4.

*Primary Examiner*—Ching Chang
(74) *Attorney, Agent, or Firm*—Luedeka, Neely & Graham, PC

(57) ABSTRACT

A valve operating mechanism for an internal combustion engine includes a drive member that engages a control arm at a contact point spaced apart from the pivot axis of the control arm, and a control member that operates to vary the contact point in order to vary a spacing between the contact point and the pivot axis of the control arm to vary the amplitude of reciprocation of a cam surface of the control arm and to vary the portion of the cam surface which is engaged by a cam follower member during pivoting of the control arm to thereby vary the amount of lift and/or opening duration of the engine valve.

32 Claims, 6 Drawing Sheets

VALVE OPERATING MECHANISM

FIELD

The disclosure relates to a valve operating mechanism for an internal combustion engine. In particular, it relates to a valve operating mechanism in which the lift and/or timing of the valve can be varied.

BACKGROUND

It is known to provide a valve operating mechanism for an internal combustion engine, in which the amount of lift of the valves and/or the opening and closing timing of the valves can be varied. One such apparatus is disclosed in WO 94/21897. This document discloses a system in which a first push rod is actuated by a camshaft, and causes a pivoted lever to oscillate. The lever has an upper arcuate surface, which supports a second push rod. The second push rod is connected to a rocker which causes the valve to be opened and closed. The second push rod is connected to the rocker by a ball and socket joint. The second push rod is moveable along the arcuate surface of the lever, such that its position on the lever affects the amount of lift of the valve. This arrangement alters the effective total length of the first and second push rods, to vary the amount of valve lift. This document also describes the use of a second camshaft connected to the pivot of the lever. The second camshaft has the function of varying the valve timing. This document has the disadvantage that a separate camshaft must be provided in order to vary valve timing, separate from the mechanism for altering valve lift.

Accordingly, improvement is desired in the construction of valve operating mechanism to provide a mechanism which avoids disadvantages of prior mechanisms.

SUMMARY

In a first aspect, the disclosure provides a valve operating mechanism for an internal combustion engine. The mechanism includes an engine valve for opening and closing a port of a cylinder of the engine; a control arm pivoting about a pivot axis and having a cam surface spaced apart from the pivot axis; a drive member which reciprocates with rotation of the engine and which acts on the control arm to rotate the control arm about the pivot axis thereof; and a cam follower member engaging the cam surface of the control arm which relays camming action of the cam surface to the engine valve The drive member engages the control arm at a contact point spaced apart from the pivot axis of the control arm and a controller is provided to vary in position the contact point in order to vary a spacing between the contact point and the pivot axis of the control arm. Varying the spacing of the contact point from the pivot axis varies amplitude of reciprocation of the cam surface of the control arm, whereby the controller can vary which part of the cam surface is engaged by the cam follower member during pivoting of the control arm to thereby vary the amount of lift and/or opening duration of the engine valve.

In a second aspect, the present disclosure provides a valve operating mechanism for an internal combustion engine, the mechanism including an engine valve for opening and closing a port of a cylinder of the engine; a control arm pivoting about a pivot axis and having a cam surface spaced apart from the pivot axis; a drive member which reciprocates with rotation of the engine and which acts on the control arm to rotate the control arm about the pivot axis thereof; and a cam follower member engaging the cam surface of the control arm which relays camming action of the cam surface to the engine valve.

The drive member engages the control arm at a contact point spaced apart from the pivot axis of the control arm and a controller is provided to vary in position the contact point in order to vary a spacing between the contact point and the pivot axis of the control arm. Varying the spacing of the contact point from the pivot axis varies amplitude of reciprocation of the cam surface of the control arm, whereby the controller can vary which part of the cam surface is engaged by the cam follower member during pivoting of the control arm to thereby vary the amount of lift and/or opening duration of the engine valve. The drive member may be, for example, a push rod actuated by a camshaft, the push rod engaging the control arm.

In a third aspect, the present disclosure provides a valve operating mechanism for an internal combustion engine, the mechanism including an engine valve for opening and closing a port of a cylinder of the engine; a control arm pivoting about a pivot axis and having a cam surface spaced apart from the pivot axis; a drive member which reciprocates with rotation of the engine and which acts on the control arm to rotate the control arm about the pivot axis thereof; and a cam follower member engaging the cam surface of the control arm which relays camming action of the cam surface to the engine valve.

The drive member engages the control arm at a contact point spaced apart from the pivot axis of the control arm. A controller is provided to vary in position the contact point in order to vary a spacing between the contact point and the pivot axis of the control arm. Varying the spacing of the contact point from the pivot axis varies amplitude of reciprocation of the cam surface of the control arm, whereby the controller can vary which part of the cam surface is engaged by the cam follower member during pivoting of the control arm to thereby vary the amount of lift and/or opening duration of the engine valve. The cam follower member may be provided, for example, by a rocker.

In a fourth aspect, the present disclosure provides a valve operating mechanism for an internal combustion engine, the mechanism including an engine valve for opening and closing a port of a cylinder of the engine; a control arm pivoting about a pivot axis and having a cam surface spaced apart from the pivot axis; a drive member which reciprocates with rotation of the engine and which acts on the control arm to rotate the control arm about the pivot axis thereof; and a cam follower member engaging the cam surface of the control arm which relays camming action of the cam surface to the engine valve.

The drive member engages the control arm at a contact point spaced apart from the pivot axis of the control arm. A controller is provided to vary in position the contact point in order to vary a spacing between the contact point and the pivot axis of the control arm. Varying the spacing of the contact point from the pivot axis varies amplitude of reciprocation of the cam surface of the control arm, whereby the controller can vary which part of the cam surface is engaged by the cam follower member during pivoting of the control arm to thereby vary the amount of lift and/or opening duration of the engine valve. The cam follower member is provided, for example, a tappet.

This disclosure advantageously enables the use of a single controller to control both the valve timing and amount of valve lift.

BRIEF DESCRIPTION OF THE DRAWINGS

Further advantages of the disclosure are apparent by reference to the detailed description when considered in conjunction with the figures, which are not necessarily to scale so as to more clearly show the details, wherein like reference numbers indicate like elements throughout the several views, and wherein.

DETAILED DESCRIPTION

Figure 1:
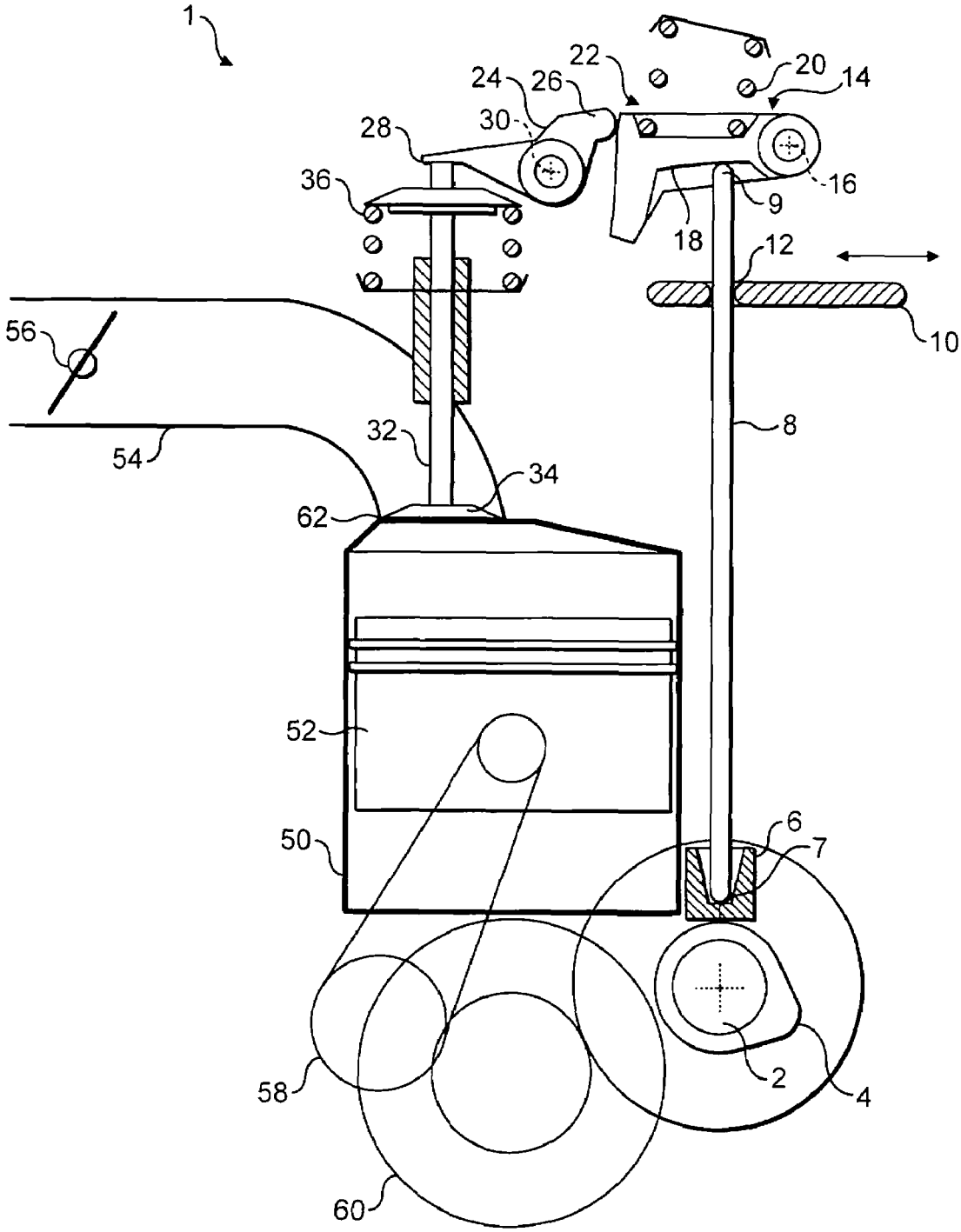
FIG. 1 is a side elevation of a first embodiment of a valve mechanism according to the disclosure in an internal combustion engine.

With reference FIG. 1, there is shown a valve operating mechanism 1 according to a first embodiment of the present disclosure connected to a part of a conventional internal combustion engine. The internal combustion engine includes a cylinder 50 receiving a piston 52. An inlet manifold 54 is throttled by a throttle 56, and opens via an inlet port 62 into the cylinder 50. The piston 52 is connected to a crankshaft 60 by a connecting rod 58.

A camshaft 2 is driven by the crankshaft 60. The camshaft 2 has a lobed camshaft surface 4. A tappet 6 engages the camshaft surface 4, and receives a first end 7 of push rod 8. The push rod 8 is an elongate drive member having a longitudinal axis extending approximately parallel to a longitudinal axis of the cylinder 50. The push rod 8 is rotatable in a plane, pivoting about the end of the pushrod which engages the tappet 6. The push rod 8 is moved to rotate by a control slide 10. The control slide 10 includes an arm having an aperture 12, through which the pushrod 8 passes. The control slide 10 is moveable in a plane substantially perpendicular to the longitudinal axis of the pushrod 8, e.g. by a mechanical or hydraulic actuator or an electric motor.

The push rod 8 has a second end 9 engaging a control arm 14. The second end 9 contacts a contact surface 18 of the arm 14. The arm 14 is rotatable about a pivot axis 16. The pivot axis 16 is located at an end of the arm 14 furthest from the valve 34. The arm 14 is biased downwardly against the push rod 8 by a spring 20. The arm 14 is provided with a cam surface 22 at an end opposite to the pivot 16. The cam surface 22 has a shaped arcuate profile, the shape determining the amount and timing of valve opening. The precise shape of the cam surface 22 is discussed below with reference to FIG. 2.

The cam surface 22 of arm 14 is engaged by a cam follower member 24 in the form of a rocker. The rocker 24 is pivoted about a pivot axis 30, and includes a part 28 extending radially out from the pivot axis 30, in the opposite direction to a cam follower part 26 of the cam follower member 24. The part 28 engages a valve stem 32 of an inlet valve 34. The valve 34 is urged upwardly into its valve seat to close the inlet port 62 by a spring 36.

Figure 2:
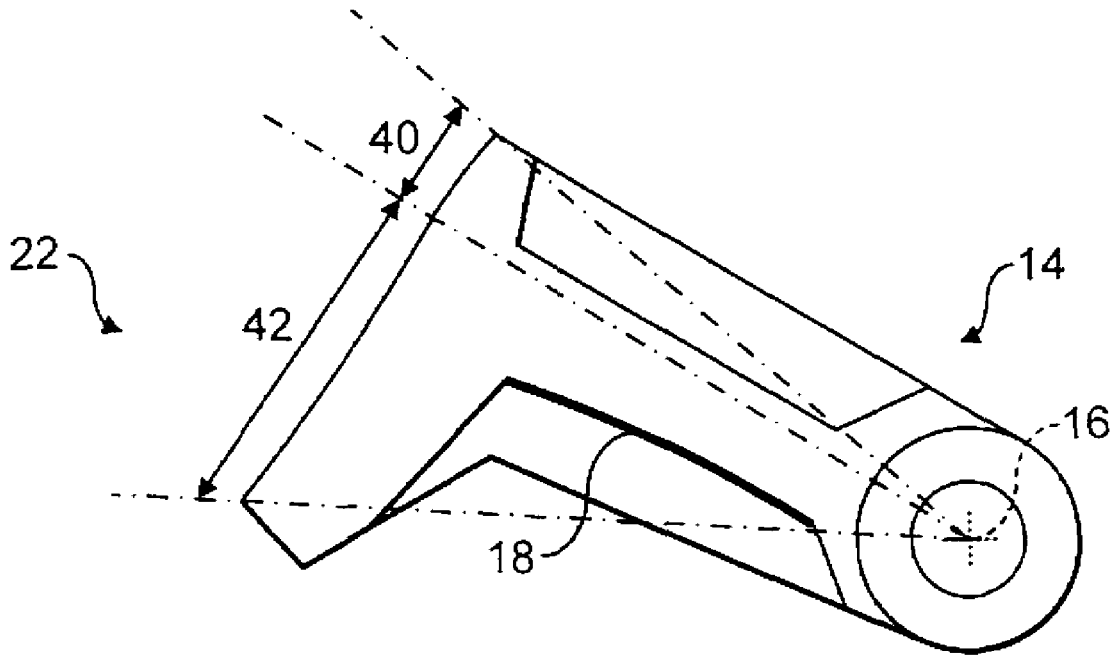
FIG. 2 is a side elevation view of a lever component utilized in mechanisms according to the disclosure.

FIG. 2 shows an enlarged view of the control arm 14 of the present disclosure. Cam surface 22 includes a constant radius section 40 and a raising lift section 42. The constant radius section 40 has a constant radius about pivot axis 16. When the cam follower member 24 moves along the constant radius section 40, no camming action is imparted to cause the cam follower member 24 to move.

The raising lift section 42 has an arcuate profile shaped to lift and close the valve at an appropriate rate and for a selected amount. When the cam follower member 24 engages the raising lift section 42 then a camming action of the section 42 causes the rocker 24 to rotate.

Figure 3A:
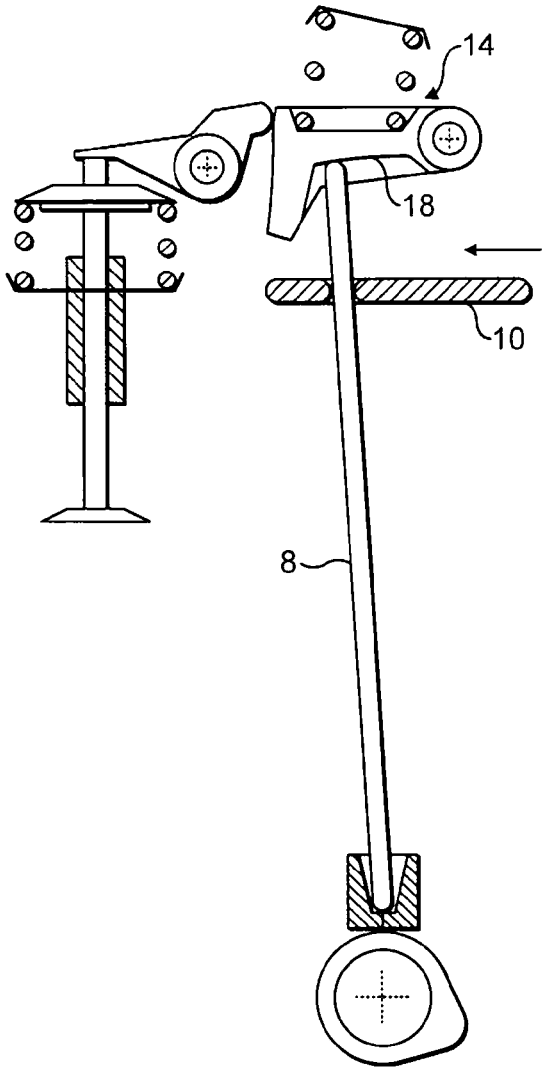
FIGS. 3*a* and 3*b* are side elevation views of the first embodiment in a first operating condition.
Figure 3B:
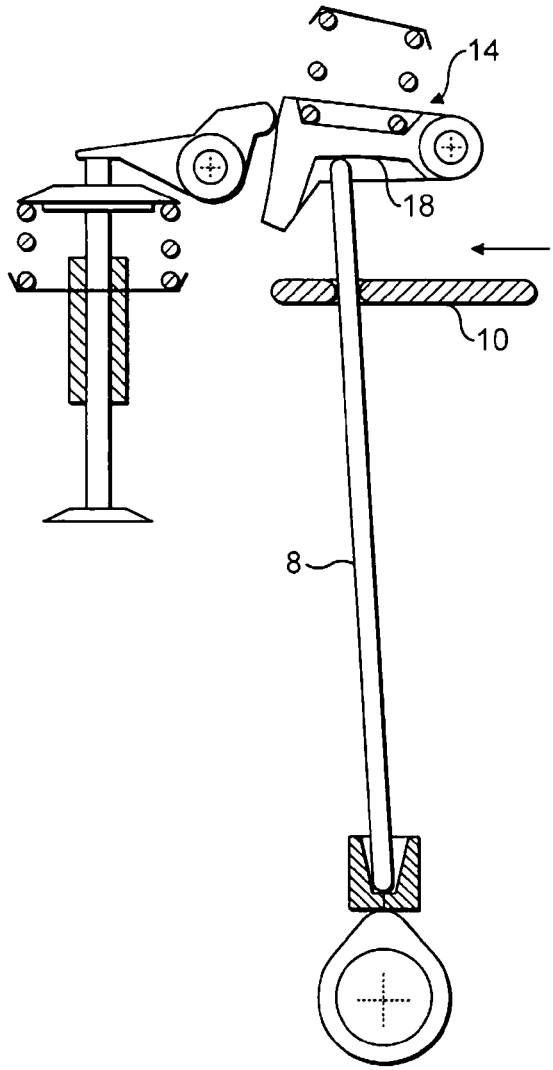

FIGS. 3*a* and 3*b* show the valve operating mechanism 1 in a first state. The control slide 10 is moved to the left to rotate the push rod 8 anti-clockwise about the lower end thereof so that the push rod 8 contacts the lower surface 18 of the control arm 14 at a position relatively distant from the pivot 16. In FIG. 3*a*, the cam shaft lobe 4 is not engaging the tappet 6, and so the valve is in a closed position.

In FIG. 3*b*, the cam shaft lobe 4 engages the tappet 6, urging the push rod 8 upwardly. The upper end 9 of the push rod 8 engaging the contact surface 18 urges the control arm 14 to rotate in a clockwise direction. The position of contact between the push rod 8 and the contact surface 18 is spaced apart from the pivot axis 16 so that the amplitude of oscillation of the push rod 8 from the lobe 4 results in a relatively small amount of rotation of the control arm 14. The control arm 14 rotates such that cam follower member 24 engages only the constant radius section 40 of the cam surface 22. The constant radius section 40 does not impart any camming action to the rocker follower 24, and so no lifting force is transmitted to the valve 34. The spring 36 therefore maintains the valve 34 in a closed position.

Figure 4A:
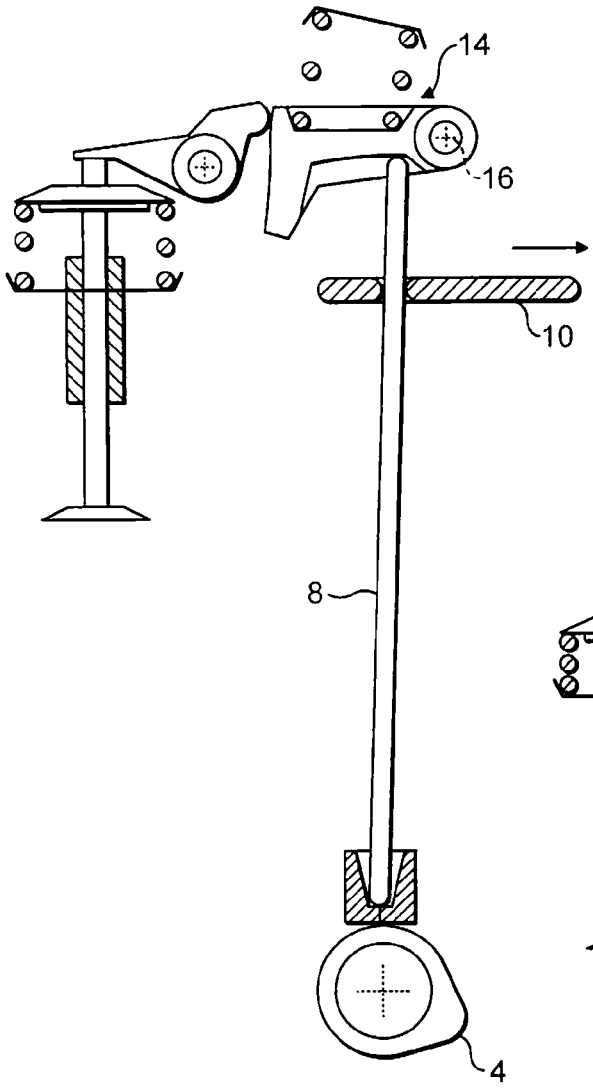
FIGS. 4*a* and 4*b* are side elevation views of the first embodiment in a second operating condition.
Figure 4B:
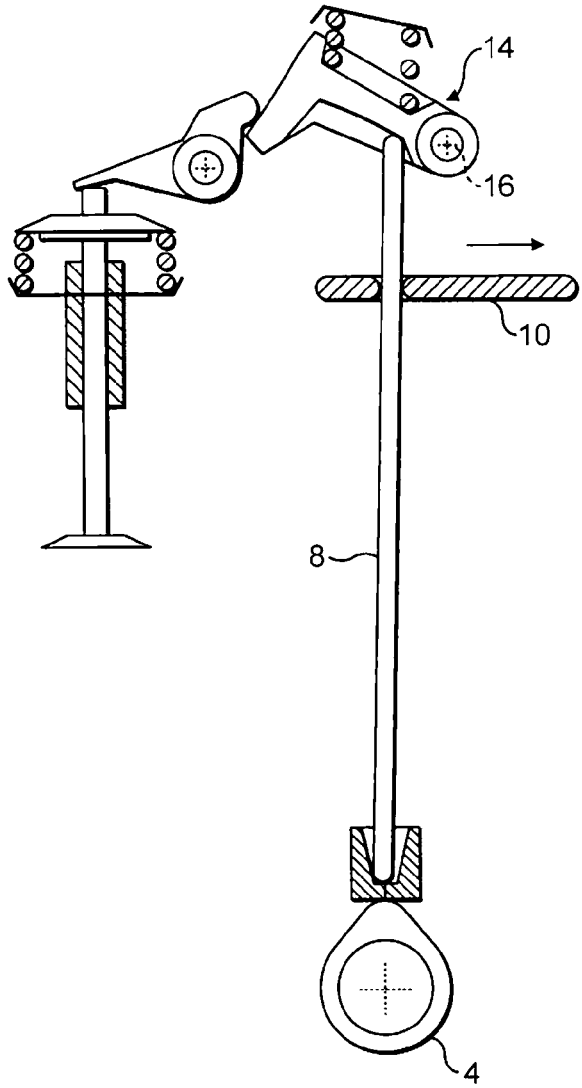

FIGS. 4*a* and 4*b* show the valve operating mechanism 1 in a second state. The control slide 10 rotates the push rod 8 clockwise about its lower end, towards the pivot axis 16. The push rod 8 therefore contacts follower surface 18 at a position relatively close to the pivot axis 16. In FIG. 4*a*, the cam shaft lobe 4 is not engaging the tappet 6, and so the valve is in a closed position.

In FIG. 4*b*, the cam shaft lobe 4 engages the tappet 6, urging the push rod 8 upwardly. The second end 9 of the push rod 8 engaging the follower surface 18 urges the control arm 14 to rotate in a clockwise direction. The position of contact between the push rod 8 and the contact surface 18 means that the amplitude of oscillation of the push rod 8 from the lobe 4 results in a relatively large amount of rotation of the control arm 14. The control arm 14 rotates such that cam follower member 24 engages the constant radius section 40 of the lever 14 and substantially all of the raising lift section 42. The raising lift section 42 imparts a camming action to the cam follower member 24, and so a lift is transmitted to the valve 34. The valve 34 is thus opened against the bias of the spring 36.

Figure 5A:
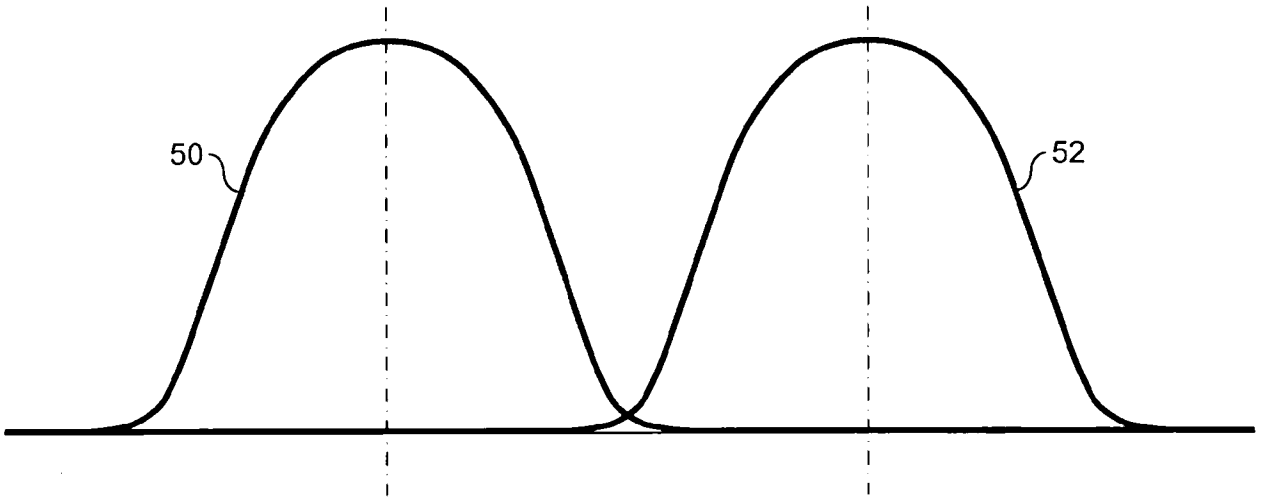
FIGS. 5*a*, 5*b* 5*c* show graphically lifts of two valves in different operating conditions of the disclosure.
Figure 5B:
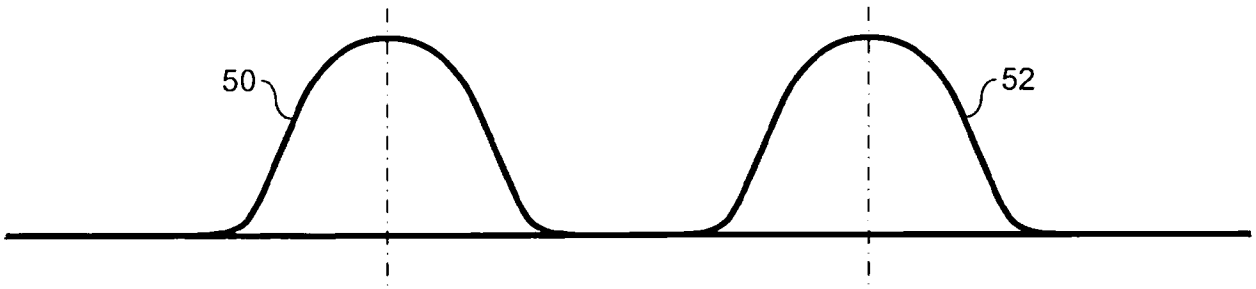
Figure 5C:
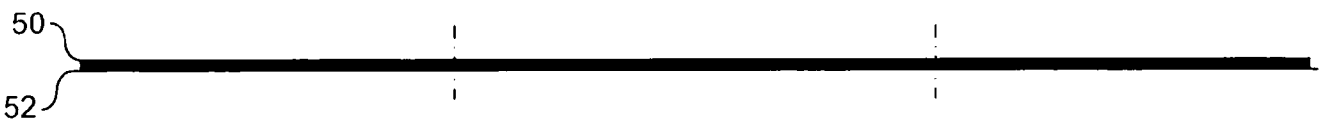

FIGS. 5*a*, 5*b*, 5*c* show valve lift for three different operating states of the present disclosure. FIGS. 5*a*, 5*b* and 5*c* show a line 50 representing lift of an exhaust valve over one complete cycle of the cylinder. Line 52 represents lift of an inlet valve over one complete cycle. The exhaust valve is also driven by an operating mechanism as previously described.

In the state shown in FIG. 5*a*, the control slide 10 is moved to the right, so that the push rod 8 engages a part of the follower surface 18 adjacent to the pivot 16. This state is described with reference to FIGS. 4*a* and 4*b* and results in maximum lift of the inlet and exhaust valves at the appropriate times. This state corresponds to an engine in a full load condition.

FIG. 5*b* shows lift of inlet and exhaust valves in a part load condition. This corresponds to the control slide 10 being in a central position, the push rod 8 engaging the follower surface 18 approximately mid-way between its edges. The cam follower member 26 engages both the constant radius section 40 and a small part of the raising lift section 42, so that a smaller amount of lift of the valve 34 is provided. The timings of the inlet and exhaust valve openings and closings are also altered in a part load state, such that each valve opens later and closes earlier than in the full load condition. The maximum lift in each of the full load and part load conditions occurs at the same point in the combustion cycle, corresponding to the cam shaft lobe 4 extending vertically upwardly.

FIG. 5*c* shows a state in which there is no lift of either the inlet or exhaust valve. This state is described with reference to FIGS. 3*a* and 3*b*, and corresponds to the control slide being moved to the left. The cam follower member engages only the constant radius section 40 of the cam surface 22.

In use, the control slide 10 is moved to control the amount of valve lift and the timings of the valve opening. When the engine is required to operate at full load, the control slide 10 is moved such that the pushrod 8 engages the lever 14 adjacent the pivot 16. When a reduced load is required, the control slide 10 is moved such that the pushrod engages the lever 14 relatively distant from the pivot 16.

Figure 6:
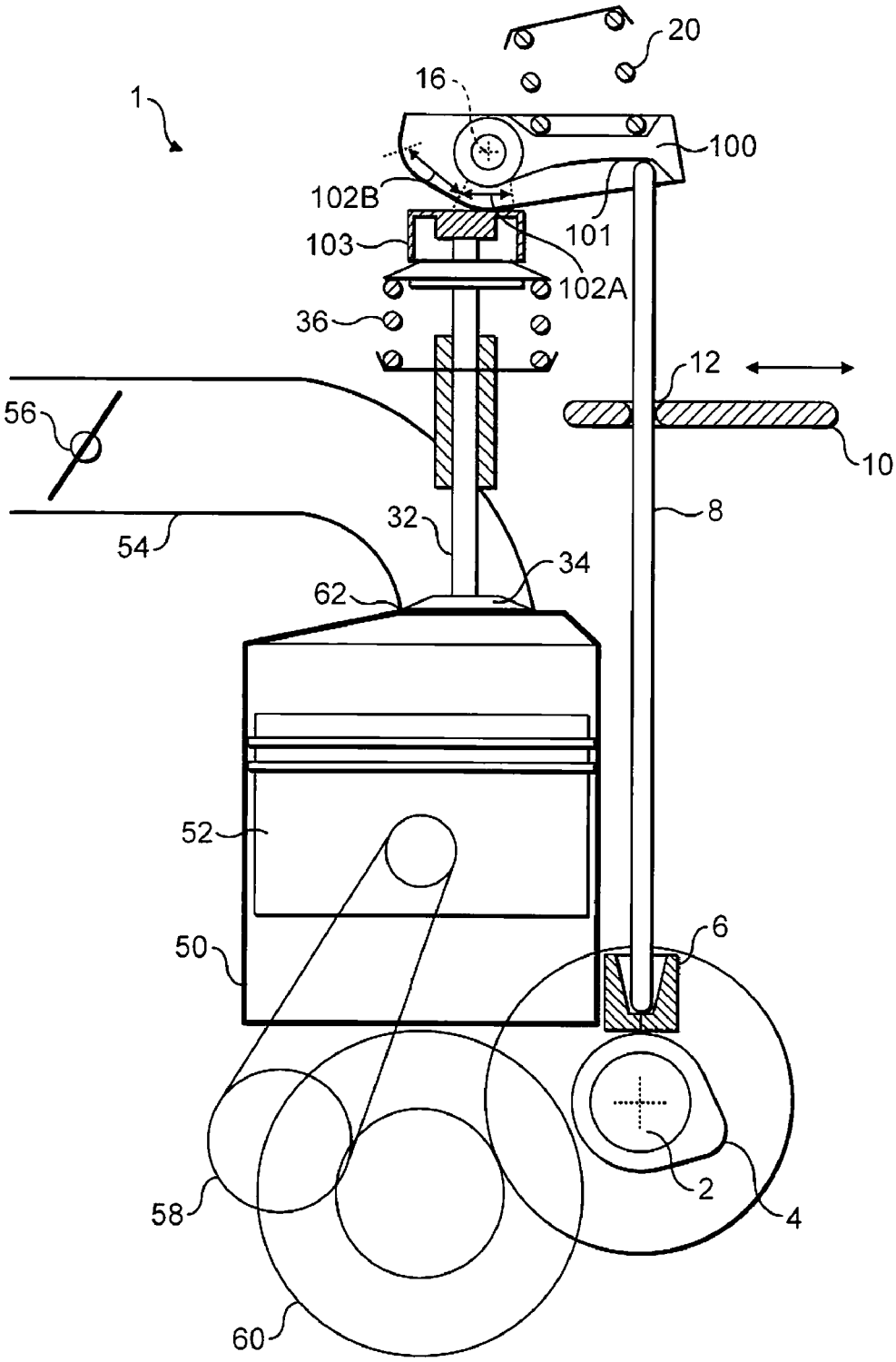
FIG. 6 is a side elevation view of a second embodiment of the disclosure.

A second embodiment of valve operating mechanism 100 according to the present disclosure is shows in FIG. 6. It shares many components in common with the previously described embodiments and components in common have identical functions and are given identical reference numerals they will not be described in detail.

The FIG. 6 embodiment has a control arm 100 which has a contact surface 101 on a first side of the pivot axis 16 thereof and a cam surface 102 provided on a second opposite side of the pivot axis 16. The cam follower member 103 is not a rocker member as in the previous embodiment, but a tappet surmounting the valve stem 32. Movement of the push rod 8 to the right as illustrated in the figure moves the contact point between the push rod 8 and the contact surface 101 further away from pivot axis 16 and decreases the amplitude of rotations of the control arm 102. Movement of the push rod 8 to the left as illustrated in the figure moves the contact point nearer the pivot axis 16 and increases the amplitude of rotation. The cam surface 102 has a portion 102A of constant radius with respect to pivot axis 16; this imparts no camming action on the tappet 103 and the valve 34 remains closed. The cam surface 102 has a portion 102A of increasing radius from the pivot axis 16: this provides a camming action which imparts lift to the valve 34 via the tappet 103.

As before, the variation of amplitude of rotation of control arm 100 varies what part of the camming surface 102 is engaged by the cam follower member/tappet 103 and therefore the lift of the valve 34 (which will be varied as previously illustrated in FIGS. 5*a*, 5*b* 5*c*).

The valve operating mechanism can be used to facilitate homogeneous charge compression ignition (sometimes called auto-ignition) in part-load operating conditions of the engine. The early closing of the exhaust valve will trap combusted gases for subsequent mixing with charge air to allow the creation of a mixture of fuel, air and combusted gases which ignites on compression.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application and to thereby enable one of ordinary skill in the art to utilize the disclosure in various embodiments and with various modifications as are suited to the particular use contemplated. All such modifications and variations are within the scope of the appended claims when interpreted in accordance with the breadth to which they are fairly, legally, and equitably entitled.

What is claimed is:

1. A valve operating mechanism for an internal combustion engine, the mechanism comprising:

an engine valve for opening and closing a port of a cylinder of the engine;

a control arm pivoting about a pivot axis and having a cam surface spaced apart from the pivot axis;

a drive member which reciprocates with rotation of the engine and which acts on the control arm to rotate the control arm about the pivot axis thereof;

a cam follower member engaging the cam surface of the control arm which relays camming action of the cam surface to the engine valve;

wherein:

the drive member engages the control arm at a contact point spaced apart from the pivot axis of the control arm;

control means is provided to vary in position the contact point in order to vary a spacing between the contact point and the pivot axis of the control arm;

varying the spacing of the contact point from the pivot axis varies amplitude of reciprocation of the cam surface of the control arm, whereby the control means can vary which part of the cam surface is engaged by the cam follower member during pivoting of the control arm to thereby vary the amount of lift and/or opening duration of the engine valve; and the drive member is a push rod actuated by a camshaft, the push rod engaging the control arm.

2. A valve operating mechanism as claimed in claim 1, wherein the cam surface has a first section having a constant radius and a second section having a non-constant radius, the engine valve being opened when the cam follower member engages the second cam surface section and remaining closed when the cam follower member engages the first cam surface section.

3. A valve operating mechanism as claimed in claim 2 wherein the cam follower member is a rocker.

4. A valve operating mechanism as claimed in claim 3 wherein the rocker abuts a valve stem of the engine valve.

5. A valve operating mechanism as claimed in claim 3 wherein the cam surface is provided on the control arm on the same side of the pivot axis as a constant surface of the control arm along which the push rod contacts the control arm.

6. A valve operating mechanism as claimed in claim 1 wherein the control means comprises a slide having an aperture through which the push rod extends.

7. A valve operating mechanism as claimed in claim 6 wherein the slide is moveable in a plane generally perpendicular to a longitudinal axis of the push rod.

8. A valve operating mechanism as claimed in claim 1 wherein the control arm is biased against the push rod by a spring.

9. A valve operating mechanism as claimed in claim 1 further comprising a tappet located between the push rod and the cam shaft, the push rod rotatable with respect to the tappet under action of the control means.

10. A valve operating mechanism as claimed in claim 1 wherein the cam surface is provided on the control arm on the opposite side of the pivot axis to a contact surface of the control arm along which the push rod contacts the control arm.

11. A valve operating mechanism as claimed in claim 1 wherein the valve is an inlet valve.

12. An internal combustion engine comprising a valve operating mechanism as claimed in claim 1.

13. A valve operating mechanism for an internal combustion engine, the mechanism comprising:

an engine valve for opening and closing a port of a cylinder of the engine;

a control arm pivoting about a pivot axis and having a cam surface spaced apart from the pivot axis;

a drive member which reciprocates with rotation of the engine and which acts on the control arm to rotate the control arm about the pivot axis thereof;

a cam follower member engaging the cam surface of the control arm which relays camming action of the cam surface to the engine valve; wherein:

the drive member engages the control arm at a contact point spaced apart from the pivot axis of the control arm;

control means is provided to vary in position the contact point in order to vary a spacing between the contact point and the pivot axis of the control arm;

varying the spacing of the contact point from the pivot axis varies amplitude of reciprocation of the cam surface of the control arm, whereby the control means can vary which part of the cam surface is engaged by the cam follower member during pivoting of the control arm to thereby vary the amount of lift and/or opening duration of the engine valve; and the drive member is a push rod actuated by a camshaft, the push rod engaging the control arm.

14. A valve operating mechanism as claimed in claim 13 wherein the control means comprises a slide having an aperture through which the push rod extends.

15. A valve operating mechanism as claimed in claim 14 wherein the slide is moveable in a plane generally perpendicular to a longitudinal axis of the push rod.

16. A valve operating mechanism as claimed in claim 13 wherein the control arm is biased against the push rod by a spring.

17. A valve operating mechanism as claimed in claim 13 further comprising a tappet located between the push rod and the cam shaft, the push rod rotatable with respect to the tappet under action of the control means.

18. A valve operating mechanism as claimed in claim 13 wherein the cam follower member is a rocker.

19. A valve operating mechanism as claimed in claim 18, wherein the rocker abuts a valve stem of the engine valve.

20. A valve operating mechanism as claimed in claim 18 wherein the cam surface is provided on the control arm on the same side of the pivot axis as the contact surface of the control arm along which the push rod contacts the control arm.

21. A valve operating mechanism as claimed in claim 13, wherein the cam follower member is a tappet.

22. A valve operating mechanism as claimed in claim 21 wherein the cam surface is provided on the control arm on the opposite side of the pivot axis to a contact surface of the control arm along which the push rod contacts the control arm.

23. A valve operating mechanism as claimed in claim 13 wherein the valve is an inlet valve.

24. A valve operating mechanism as claimed in claim 13 wherein the valve is an exhaust valve.

25. An internal combustion engine having a valve operating mechanism as claimed in claim 24 wherein the cam surface is configured such that at part loads the rotation of the control arm causes the cam follower to move along a part of the cam surface which operates the exhaust valve to close prior to an end of an exhaust stroke to trap combusted gases in the cylinder, which trapped combusted gases are subsequently mixed with fresh charge air and fuel to create a mixture which ignites by homogeneous charge compression ignition.

26. An internal combustion engine comprising a valve operating mechanism as claimed in claim 13.

27. A valve operating mechanism for an internal combustion engine, the mechanism comprising:

an engine valve for opening and closing a port of a cylinder of the engine;

a control arm pivoting about a pivot axis and having a cam surface spaced apart from the pivot axis;

a drive member which reciprocates with rotation of the engine and which acts on the control arm to rotate the control arm about the pivot axis thereof;

a cam follower member engaging the cam surface of the control arm which relays camming action of the cam surface to the engine valve;

wherein:

the drive member engages the control arm at a contact point spaced apart from the pivot axis of the control arm;

control means is provided to vary in position the contact point in order to vary a spacing between the contact point and the pivot axis of the control arm;

varying the spacing of the contact point from the pivot axis varies amplitude of reciprocation of the cam surface of the control arm, whereby the control means can vary which part of the cam surface is engaged by the cam follower member during pivoting of the control arm to thereby vary the amount of lift and/or opening duration of the engine valve;

the cam follower member is a rocker;

the valve is an exhaust valve; and the cam surface is configured such that at part loads the rotation of the control arm causes the cam follower to move along a part of the cam surface which operates the exhaust valve to close prior to an end of an exhaust stroke to trap combusted gases in the cylinder, which trapped combusted gases are subsequently mixed with fresh charge air and fuel to create a mixture which ignites by homogeneous charge compression ignition.

28. A valve operating mechanism as claimed in claim 27 wherein the rocker abuts a valve stem of the engine valve.

29. A valve operating mechanism as claimed in claim 27 wherein the cam surface is provided on the control arm on the same side of the pivot axis as a contact surface of the control arm along which the drive member contacts the control arm.

30. A valve operating mechanism as claimed in claim 27 wherein the valve is an inlet valve.

31. An internal combustion engine comprising a valve operating mechanism as claimed in claim 27.

32. A valve operating mechanism for an internal combustion engine, the mechanism comprising:

an engine valve for opening and closing a port of a cylinder of the engine;

a control arm pivoting about a pivot axis and having a cam surface spaced apart from the pivot axis;

a drive member which reciprocates with rotation of the engine and which acts on the control arm to rotate the control arm about the pivot axis thereof;

a cam follower member engaging the cam surface of the control arm which relays camming action of the cam surface to the engine valve;

wherein:

the drive member engages the control arm at a contact point spaced apart from the pivot axis of the control arm;

control means is provided to vary in position the contact point in order to vary a spacing between the contact point and the pivot axis of the control arm;

varying the spacing of the contact point from the pivot axis varies amplitude of reciprocation of the cam surface of the control arm, whereby the control means can vary which part of the cam surface is engaged by the cam follower member during pivoting of the control arm to thereby vary the amount of lift and/or opening duration of the engine valve;

the valve is an exhaust valve; and the cam surface is configured such that at part loads the rotation of the control arm causes the cam follower to move along a part of the cam surface which operates the exhaust valve to close prior to an end of an exhaust stroke to trap combusted gases in the cylinder, which trapped combusted gases are subsequently mixed with fresh charge air and fuel to create a mixture which ignites by homogeneous charge compression ignition.

* * * * *

UNITED STATES PATENT AND TRADEMARK OFFICE

CERTIFICATE OF CORRECTION

PATENT NO. : 7,603,971 B2
APPLICATION NO. : 11/550082
DATED : October 20, 2009
INVENTOR(S) : Jeffrey Allen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 431 days.

Signed and Sealed this

Fifth Day of October, 2010

David J. Kappos

David J. Kappos
*Director of the United States Patent and Trademark Office*